US009711280B2

(12) United States Patent
Uesaka et al.

(10) Patent No.: US 9,711,280 B2
(45) Date of Patent: Jul. 18, 2017

(54) METHOD FOR PREPARING RARE EARTH SINTERED MAGNET

(71) Applicant: Shin-Etsu Chemical Co., Ltd., Tokyo (JP)

(72) Inventors: Eiji Uesaka, Echizen (JP); Osamu Kohno, Echizen (JP); Kenji Imamura, Echizen (JP); Yoshihiro Umebayashi, Echizen (JP); Takahiro Hashimoto, Echizen (JP)

(73) Assignee: SHIN-ETSU CHEMICAL CO., LTD., Chiyoda-ku (JP)

( * ) Notice: Subject to any disclaimer, the term of this patent is extended or adjusted under 35 U.S.C. 154(b) by 117 days.

(21) Appl. No.: 14/678,529

(22) Filed: Apr. 3, 2015

(65) Prior Publication Data

US 2015/0294788 A1 Oct. 15, 2015

(30) Foreign Application Priority Data

Apr. 9, 2014 (JP) ..... 2014-080219

(51) Int. Cl.
*H01F 41/02* (2006.01)
*B22F 3/03* (2006.01)
(Continued)

(52) U.S. Cl.
CPC ..... *H01F 41/0266* (2013.01); *B22F 1/0081* (2013.01); *B22F 3/03* (2013.01);
(Continued)

(58) Field of Classification Search
CPC ..... H01F 41/0266; B22F 1/0081; B22F 3/12; B22F 3/02
See application file for complete search history.

(56) References Cited

U.S. PATENT DOCUMENTS 4,419,413 A 12/1983 Ebihara
6,432,158 B1 8/2002 Harada et al.
(Continued)

FOREIGN PATENT DOCUMENTS

EP 1 153 223 A1 11/2001
JP 58-9901 7/1981
(Continued)

OTHER PUBLICATIONS

Extended European Search Report dated Sep. 3, 2015, issued in counterpart European Application No. 15161496.3 (7 pages).
(Continued)

*Primary Examiner* — Rebecca Lee
(74) *Attorney, Agent, or Firm* — Westerman, Hattori, Daniels & Adrian, LLP

(57) ABSTRACT

A rare earth sintered magnet is prepared from a corresponding alloy powder, using a mold comprising a die, an upper punch, and a lower punch which is divided into a plurality of punch segments which are independently movable within the die. The method comprises the steps of filling the mold cavity with the alloy powder when one or more selected punch segments are moved to a higher position than the remaining punch segments; moving the selected punch segments down to the position where the selected and remaining punch segments assume the normal shape of the lower punch during the compression step; compressing the alloy powder between the upper and lower punches under a magnetic field while the normal shape of the lower punch is maintained, for thereby molding a compact; and heat treating the compact.

19 Claims, 4 Drawing Sheets

(51) Int. Cl.

| | |
|---|---|
| ***B22F 1/00*** | (2006.01) |
| ***H01F 1/053*** | (2006.01) |
| ***H01F 1/08*** | (2006.01) |
| ***B30B 11/00*** | (2006.01) |
| *B22F 3/00* | (2006.01) |
| *B22F 3/02* | (2006.01) |
| *B22F 3/12* | (2006.01) |

(52) U.S. Cl.

CPC ..... *B30B 11/008* (2013.01); *H01F 1/0536* (2013.01); *H01F 1/086* (2013.01); *H01F 41/0246* (2013.01); *B22F 3/004* (2013.01); *B22F 3/02* (2013.01); *B22F 3/12* (2013.01); *B22F 2003/033* (2013.01); *B22F 2998/10* (2013.01); *B22F 2999/00* (2013.01); *C22C 2202/02* (2013.01)

(56) References Cited

U.S. PATENT DOCUMENTS

| | | | | |
|---|---|---|---|---|
| 6,656,417 | B2 | 12/2003 | Kohara et al. | |
| 6,755,883 | B2 | 6/2004 | Kohara et al. | |
| 2013/0135070 | A1* | 5/2013 | Ozeki et al. | 335/302 |

FOREIGN PATENT DOCUMENTS

| | | | | |
|---|---|---|---|---|
| JP | S57-185726 | U | | 11/1982 |
| JP | 58-75721 | | | 5/1983 |
| JP | H03-119000 | A | | 5/1991 |
| JP | 2000-326100 | A | | 11/2000 |
| JP | 2001-58294 | A | | 3/2001 |
| JP | 2001-192705 | A | | 7/2001 |
| JP | 2005-205481 | A | | 8/2005 |
| JP | 2006-156425 | A | | 6/2006 |
| JP | 2006156425 | A | * | 6/2006 |
| WO | 00/46520 | A1 | | 8/2000 |

OTHER PUBLICATIONS

Office Action dated May 9, 2017, issued in counterpart Japanese Application No. 2014-080219, with machine translation. (6 pages).

* cited by examiner

METHOD FOR PREPARING RARE EARTH SINTERED MAGNET

CROSS-REFERENCE TO RELATED APPLICATION

This non-provisional application claims priority under 35 U.S.C. §119(a) on Patent Application No. 2014-080219 filed in Japan on Apr. 9, 2014, the entire contents of which are hereby incorporated by reference.

TECHNICAL FIELD

This invention relates to a method for preparing a rare earth sintered magnet, and more particularly, to a method for preparing a rare earth sintered magnet of unique shape, typically C or D shape by filling a mold cavity with an alloy powder and compression molding the powder under a magnetic field.

BACKGROUND ART

Nowadays, by virtue of their superior magnetic properties, rare earth sintered magnets, typically neodymium-based magnets are widely used in motors, sensors and other devices to be mounted in hard disks, air conditioners, hybrid vehicles, and the like.

In general, rare earth sintered magnets are prepared by powder metallurgy as follows. First, raw materials are mixed in accord with a predetermined composition. Using a high-frequency induction furnace, the mixture is melted and cast into an alloy. The alloy is coarsely crushed by a grinding machine such as a jaw crusher, Brown mill or pin mill or hydrogen decrepitation (or hydrogen embrittlement treatment) and then finely milled by a jet mill or the like, obtaining a fine powder having an average particle size of 1 to 10 μm. The fine powder is molded into a compact of desired shape while applying a magnetic field for imparting magnetic anisotropy. The compact is sintered and heat treated to form a sintered magnet.

In the preparation of rare earth sintered magnets by powder metallurgy, the step of molding under a magnetic field typically uses a mold consisting of a die, an upper punch and a lower punch. Molding is carried out by filling the mold cavity defined between the die and the lower punch with the fine powder, and forcing the upper punch to apply a uniaxial pressure to the powder. The mold cavity is fully filled with the fine powder so that the top of the powder may be flush with the upper surface of the die.

In the molding step, it is practiced for the purpose of improving the production yield to compression mold the powder into a compact shape which is close to the shape of the final magnet product. In an example where the final magnet product is of C shape, the powder is molded into a compact of an approximate C shape. To this end, the pressure surfaces of the upper and lower punches are shaped non-planar. In this case, if the mold cavity is fully filled with fine powder so that the top of powder may be flush with the upper surface of the die, the amount of powder in the cavity per height of a magnet product to be molded is non-uniform among horizontally spaced apart positions. When the powder is compression molded in this state, the molded compact has a varying density owing to the difference of fill amount. A problem arises when this compact is sintered. Namely, due to a difference in shrinkage between different sites in the compact, the sintered body can be warped or deformed and at the worst, cracked or fissured. These problems invite a drop of production yield.

As means for preventing the sintered body from cracking or fissure, Patent Document 1 discloses a method of chamfering the working surface of a punch, and adjusting the chamfer width and/or refining the roughness of the working surface. Although the method is effective for preventing the sintered body from cracking or fissure, the method is limited to the preparation of magnets of a special shape that permits a mold to be chamfered. Since the problem of compact density pointed out above remains unsolved, the method is substantially ineffective for suppressing the sintered body from warp or deformation.

Patent Document 2 discloses a powder feeder box including a box housing and a guide for leveling the powder flat wherein the powder is smoothed out conformal to the upper shape of the compact to be molded. This method eliminates the difference of fill amount and hence, the variation of compact density. However, the assembly of the feeder box is cumbersome, indicating inefficiency. A number of guides are necessary to meet the shape of every upper punch. The apparatus is thus redundant.

CITATION LIST

Patent Document 1: JP-A 2001-058294
Patent Document 2: JP-A 2005-205481
Patent Document 3: JP-A 2006-156425

DISCLOSURE OF INVENTION

An object of the invention is to provide a method for preparing a rare earth sintered magnet of unique shape, typically C or D shape, which method is effective for preventing the sintered body from warp or deformation and even from cracking or fissure while improving the production yield.

The invention is directed to a method for preparing a rare earth sintered magnet of unique shape, typically C or D shape by uniaxial compression of a rare earth magnet-forming alloy powder using a mold comprising a die, an upper punch, and a lower punch, with a cavity defined between the die and the lower punch. The lower punch is divided into a plurality of punch segments which are independently movable within the die in the compression direction. While one or more selected punch segments are moved up such that their pressure surface are positioned relatively higher than the pressure surface of the remaining punch segments, the cavity is filled with the alloy powder. Thereafter, the selected punch segments are moved down until the pressure surface of the joined punch segments assumes the normal shape of the lower punch during the compression step. Thereafter, the alloy powder is compressed between the upper and lower punches, for thereby achieving uniaxial pressure molding under a magnetic field to form a compact. Finally, the compact is heat treated into a sintered body, i.e., rare earth sintered magnet. The method is effective for preventing the sintered body from warp or deformation and even from cracking or fissure and thus successful in manufacturing rare earth sintered magnets in high yields.

The invention provides a method for preparing a rare earth sintered magnet from a corresponding alloy powder using a mold, said mold comprising a die, an upper punch having a pressure surface, and a lower punch having a pressure surface, the pressure surface of one or both of the upper and lower punches being shaped non-planar, a cavity being defined between the die and the lower punch, said method comprising the steps of filling the cavity with the alloy powder, compressing the alloy powder in the cavity between the upper and lower punches under a magnetic field for uniaxial pressure molding to form a compact, and heat treating the compact. The method is characterized in that the lower punch is divided into a plurality of punch segments which are independently movable within the die in the compression direction, provided that the pressure surface of the lower punch during the compression step has a normal shape; in the step of filling the cavity with the alloy powder, one or more selected punch segments are moved to such a position that their pressure surface is positioned relatively higher than the pressure surface of the remaining punch segments; the selected punch segments are then moved down until they join with the remaining punch segments to assume the normal shape of the lower punch during the compression step; in the subsequent step of compressing the alloy powder between the upper and lower punches, the normal shape of the pressure surface of the lower punch is maintained, for thereby achieving uniaxial pressure molding under a magnetic field to form a compact.

In a preferred embodiment, the selected punch segments are moved down while a magnetic field is applied.

In a preferred embodiment, the method further comprises, after the pressure molding step, the step of withdrawing the compact from the die by relatively moving the upper and lower punches and the die while the compact in the mold is kept under pressure by the upper and/or lower punch. In a more preferred embodiment, during the step of withdrawing the compact, the pressure on the compact is increased or decreased when the upper and lower punches and the die are relatively moved.

In a preferred embodiment, the top of the alloy powder is leveled during or after the filling step.

In a preferred embodiment, the selected punch segments are disposed at positions where the vertical thickness of the compact is thin.

In a preferred embodiment, at least a portion of the pressure surface of one or both of the upper and lower punches is a curved surface of arch or inverse arch shape.

In a preferred embodiment, the pressure surface of the upper punch is a curved surface of arcuate arch shape.

In a preferred embodiment, the pressure surface of the lower punch consists of a central surface section having parallel side edges and two flanks extending from the side edges of the central surface section. In a more preferred embodiment, the central surface section is a horizontal surface or a curved surface of arcuate arch shape, and the flank is a horizontal surface or a curved or flat surface inclined toward the convex side of the arch.

In a preferred embodiment, the selected punch segments of the lower punch are two punch segments having a pressure surface corresponding to the flanks, and the remaining is one punch segment having a pressure surface corresponding to the central surface section.

Advantageous Effects of Invention

The method is effective for preparing a rare earth sintered magnet of unique shape, typically C or D shape and of quality in a consistent manner and in high yields while preventing the sintered body from warp or deformation and even from cracks or fissures. The method ensures efficient preparation of sintered magnets. It is of great worth in the industry.

Figure 1:
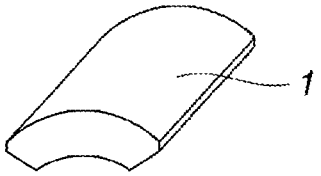
FIG. 1 is a perspective view of one exemplary magnet of C shape.

In the following description, like reference characters designate like or corresponding parts throughout the several views shown in the figures. It is also understood that the terms "upper," "lower," "upward," "downward," and analogues are often used with reference to the vertical cross-sectional views of FIG. 4 since the mold is generally kept upright.

DESCRIPTION OF PREFERRED EMBODIMENTS

By the method of the invention, a rare earth sintered magnet is prepared by feeding a rare earth magnet-forming alloy powder into a mold cavity until the cavity is filled with the alloy powder, and compressing the alloy powder under a magnetic field. The method is best suited for the preparation of magnets having a non-planar shaped surface, typically curved surface, that is, of unique shape, typically C or D shape. The method for preparing a rare earth sintered magnet relies on compression molding using a mold comprising a die, an upper punch having a pressure surface, and a lower punch having a pressure surface. The pressure surface of one or both of the upper and lower punches is shaped non-planar, depending on the unique shape of a magnet to be prepared such as C or D shape.

Figure 2A:
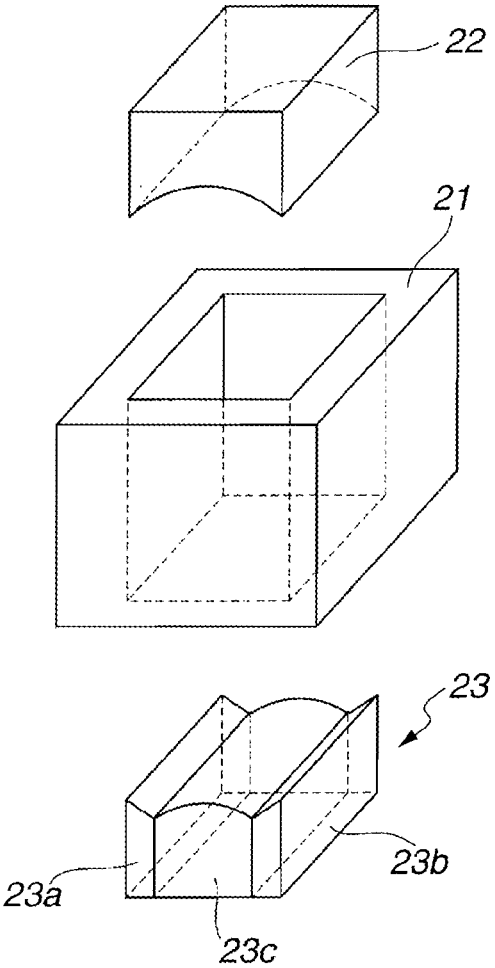
FIG. 2 illustrates one exemplary mold used in the magnet preparing method of the invention, FIG. 2(A) being perspective views, and FIG. 2(B) being vertical cross-sectional views.

Specifically, when a sintered magnet 1 of C shape as shown in FIG. 1 is prepared, a mold as shown in FIG. 2 may be used. The mold includes a die 21 having an inner wall corresponding to the side surfaces of C-shaped magnet 1, an upper punch 22 having a (downward) pressure surface corresponding to the upper surface of magnet 1, and a lower punch 23 having an (upward) pressure surface corresponding to the lower surface of magnet 1. More specifically, the pressure surface of upper punch 22 consists of a curved surface of arcuate arch shape, and the pressure surface of lower punch 23 consists of a central surface section having two parallel side edges, which is a curved surface of arcuate arch shape in the illustrated embodiment, and two flanks (or side surface sections) extending from the side edges of the central surface section, which are two flat flanks inclined toward the convex side of the arch in the illustrated embodiment. The shape of the central surface section and flanks is not limited to the illustrated embodiment. The central surface section may be a horizontal surface or a curved surface of arcuate arch shape or arcuate inverse arch shape, and the flank may be a horizontal surface or a curved or flat surface inclined toward the convex or concave side of the arch.

When both the central surface section and the flanks are horizontal surfaces, which means that the lower punch has a pressure surface of planar shape, the pressure surface of the upper punch must be of non-planar shape.

The non-planar shapes of upper and lower punches are not limited to the shapes of upper and lower punches 22 and 23 shown in FIG. 2. For example, it is acceptable that either one of the upper and lower punches has a pressure surface of non-planar shape and the other punch has a pressure surface of planar shape. The non-planar shape is preferably such that at least a portion (i.e., a portion or entirety) of the pressure surface is a curved surface. The curved surface may be of dome shape, inverse dome shape, arch shape including arcuate arch, or inverse arch shape including arcuate inverse arch. In particular, it is preferred that at least a portion of the pressure surface of the upper punch be a curved surface of arch shape.

The non-planar shape may also be such that a portion of the pressure surface is a curved surface of dome, inverse dome, arch or inverse arch shape while the remainder is a curved surface of different shape or a planar surface. Exemplary are a shape consisting of a curved surface segment of dome or inverse dome shape and an outer circumferential segment extending outward from the periphery of the curved surface segment, and a shape consisting of a curved surface segment of arch shape (e.g., arcuate arch shape) or inverse arch shape (e.g., arcuate inverse arch shape) and two flank segments extending outward from the opposite edges of the curved surface segment. The outer circumferential segment or flank segments may be either curved or planar. The extending outer circumferential segment or flank segments may be inclined toward the convex side of dome, inverse dome, arch or inverse arch shape, or inclined opposite to the convex side, or horizontal.

According to the invention, the lower punch is divided into a plurality of punch segments which are independently movable within the die in the compression direction. Preferably 2 to 10, typically 2 or 3 divided punch segments are received in the die for single motion in a vertical direction. When it is desired to prepare a sintered magnet of C shape as shown in FIG. 1, the lower punch 23 of the shape shown in FIG. 2 may be used. The lower punch 23 is composed of three divided punch segments, first punch segments 23*a*, 23*b* (corresponding to selected punch segments) and a second punch segment 23*c* (corresponding to the remaining punch segments). The pressure surfaces of first punch segments 23*a*, 23*b* provide two flanks of the pressure surface of lower punch 23 whereas the pressure surface of second punch segment 23*c* provides the central section of the pressure surface of lower punch 23.

Figure 3A:
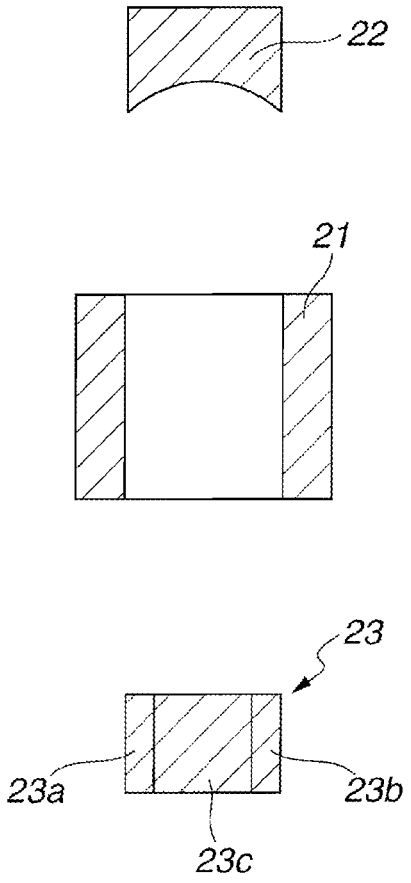
FIG. 3(A) illustrates another exemplary mold used in the magnet preparing method of the invention.
Figure 3B:
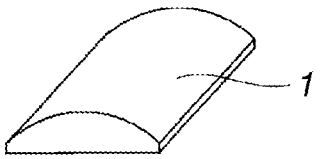
FIG. 3(B) is a perspective view of a magnet of D shape.

For use in the magnet preparation method of the invention, another mold as shown in FIG. 3 is also preferred. The mold of FIG. 3(A) includes an upper punch 22 having a pressure surface of arcuate arch shape, and a lower punch 23 having a pressure surface of horizontal planar shape. The pressure surface of the lower punch 23 is composed of a horizontal central surface section and two horizontal flanks extending from the side edges of the central section. The lower punch 23 is composed of three divided punch segments, first punch segments 23*a*, 23*b* and a second punch segment 23*c*. The pressure surfaces of first punch segments 23*a*, 23*b* provide two flanks of the pressure surface of lower punch 23 whereas the pressure surface of second punch segment 23*c* provides the central section of the pressure surface of lower punch 23. Using the thus configured mold, a sintered magnet 1 of D shape as shown in FIG. 3(B) may be prepared. The mold used in the inventive method is not limited to the die having a single bore. For example, use may be made of a mold comprising a die having a plurality of, for example, 2 to 10 bores and a plurality of upper and lower punches adapted to fit in the corresponding bores.

In either of the molds of FIGS. 2 and 3, it is provided that the pressure surface of the lower punch during the compression step has a normal shape (for the compact or magnet to be molded).

The invention may be applied to the preparation of either Nd-based or Sm-based rare earth sintered magnets. When the invention is applied to Nd-based rare earth sintered magnets, exemplary is an alloy composition consisting of 20 to 35% by weight of R which is at least one rare earth element selected from Nd, Pr, Dy, Tb and Ho, up to 15% by weight of Co, 0.2 to 8% by weight of B, up to 8% by weight of at least one additive element selected from Ni, Nb, Al, Ti, Zr, Cr, V, Mn, Mo, Si, Sn, Ga, Cu and Zn, and the balance of Fe, and incidental impurities. A rare earth sintered magnet-forming alloy powder preferably has an average particle size of 1 to 10 μm after fine milling on a jet mill or the like. The average particle size may be determined, for example, by the laser light diffraction method as a median diameter.

Figure 4A:
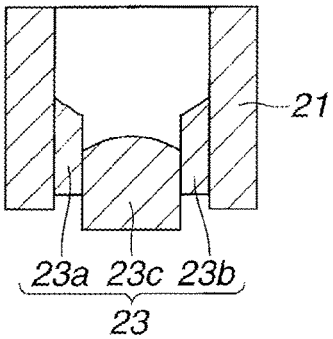
FIGS. 4A-4F schematically illustrate steps of the magnet preparation method according to one embodiment of the invention.

The invention uses the mold including the die, the upper punch, and the lower punch composed of a plurality of divided punch segments. A cavity is defined between the die and the lower punch. The mold cavity is filled with the alloy powder when selected punch segments (first punch segments) are moved up such that their pressure surface is positioned relatively higher than the pressure surface of the remaining punch segments (second punch segment). Where the mold shown in FIG. 2 is used, for example, the first punch segments 23*a*, 23*b* are moved upward at a higher position than the second punch segment 23*c* as shown in FIG. 4(A). In this state, the cavity is filled with the alloy powder.

Figure 4B:
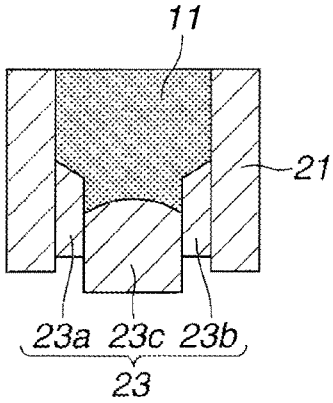
Figure 4C:
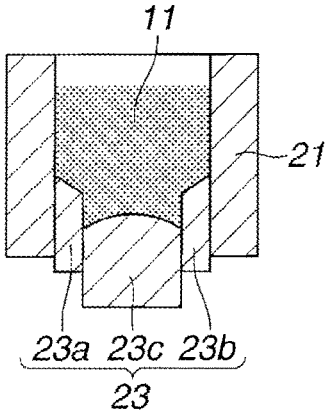

Although the step of filling the cavity with the alloy powder is not particularly limited, the cavity is typically filled with the alloy powder 11 up to a level corresponding to the upper edge of the die 21 as shown in FIG. 4(B). The top of the alloy powder 11 is preferably leveled during or after the filling step. Thereafter, the die 21 is preferably moved upward relative to the lower punch 23 as shown in FIG. 4(C), if necessary, for the purposes of preventing the alloy powder from scattering and providing an opening for the upper punch to fit in. The relative movement means that the die 21 is moved upward and/or the overall lower punch 23 is moved downward.

Figure 2B:
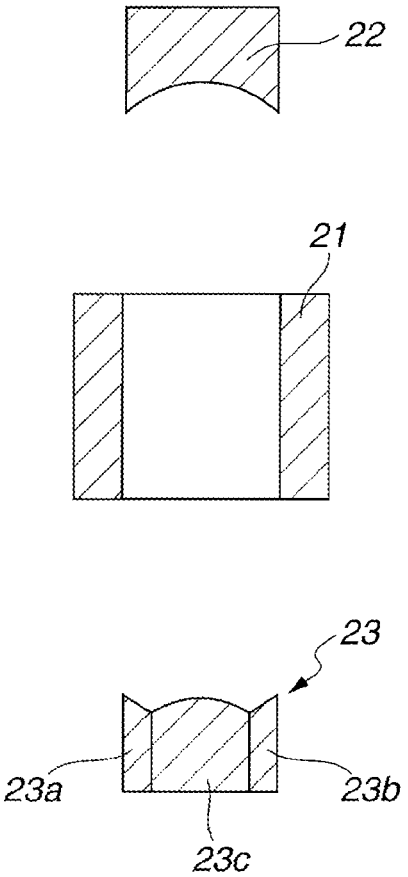

Once the cavity is filled with the alloy powder, the selected punch segments (first punch segments) are moved down until the selected punch segments (first punch segments) join with the remaining punch segments (second punch segment) to assume the normal shape of the lower punch during the compression step. Where the mold shown in FIG. 2 is used, for example, the first punch segments 23*a*, 23*b* are moved down until the first punch segments 23*a*, 23*b* join with the second punch segment 23*c* to assume the normal shape of the lower punch during the compression step, as shown in FIG. 4(D), that is, the shape that corresponds to the shape of the lower surface of a sintered magnet and that is composed of the central section which is a curved surface of arcuate arch shape and two flat flanks extending from the side edges of the central section and inclined toward the convex side of the arch (the shape of normally joined punch segments shown in FIG. 2(B)).

With this downward movement of selected punch segments (first punch segments), the alloy powder on the selected punch segments (first punch segments) is also moved down. The procedure of once moving upward selected punch segments (first punch segments), filling the cavity with the alloy powder, and then moving downward the selected punch segments (first punch segments) ensures that the amount of the alloy powder deposited at the position where the vertical thickness of the compact (and hence, magnet) is thin is reduced (that is, the height of the alloy powder is reduced). As a result, the density of the compact (and hence, magnet) is made uniform throughout, which is effective for preventing the compact from warp, deformation, cracks, and fissures. In this sense, it is advantageous to locate selected punch segments (first punch segments) at the position where the vertical thickness of the compact is thin.

Figure 4D:
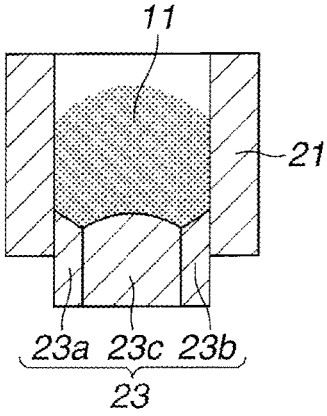

After the selected punch segments (first punch segments) are moved downward (FIG. 4(D)), the upper punch 22 is rested on top of the alloy powder 11 as shown in FIG. 4 (E). The invention is not limited to this embodiment. The upper punch 22 may be rested on top of the alloy powder 11 before the selected punch segments (first punch segments) are moved downward.

In the practice of the invention, the step of moving downward the selected punch segments (first punch segments) is preferably carried out while a magnetic field is applied across the alloy powder. In the preferred procedure, the upper punch 22 is rested on top of the alloy powder 11 as shown in FIG. 5(A), and a magnetic field is applied thereacross, before the selected punch segments (first punch segments 23*a*, 23*b*) are moved downward. Preferably a magnetic field of 1.0 to 2.5 tesla (T) is applied during downward movement of the selected punch segments (first punch segments). With the upper punch 22 rested on top of the alloy powder 11, the selected punch segments (first punch segments) are moved downward. As the upper punch 22 is forced to move down, the alloy powder 11 is confined in the cavity as shown in FIG. 5(B). The components in FIG. 5 are designated by the same numerals as in FIG. 4 and their description is omitted.

Since the selected punch segments (first punch segments) are moved downward under the applied magnetic field, alloy powder particles deposited on the selected punch segments (first punch segments) descend while the particles are kept magnetized, dispersed and oriented. If the packing density of alloy powder particles deposited on the selected punch segments (first punch segments) is equal to the packing density of alloy powder particles deposited on the remaining punch segments (second punch segment), those alloy powder particles on the selected punch segments descend with the packing density maintained. If the packing density of alloy powder particles deposited on the remaining punch segments (second punch segment) is higher than the packing density of alloy powder particles deposited on the selected punch segments (first punch segments), some powder particles shift from the remaining punch segment (second punch segment) side to the selected punch segment (first punch segment) side as alloy powder particles descend, achieving uniformity of packing density. A uniform packing density is available in either case.

Figure 4E:
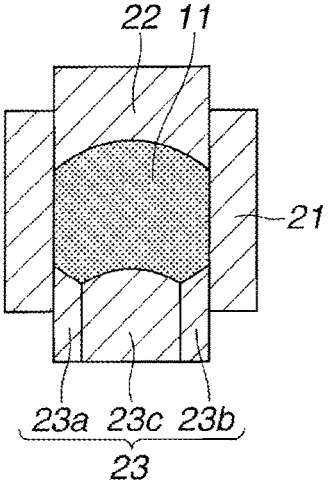
Figure 4F:
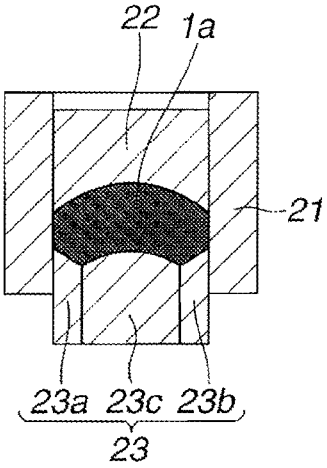
Figure 5A:
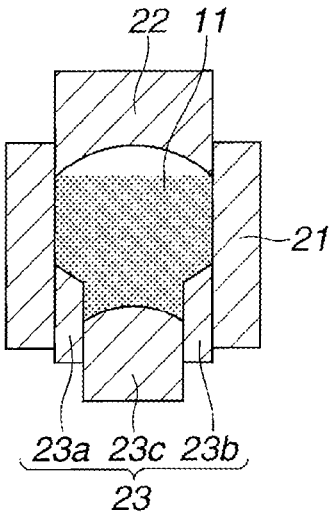
FIGS. 5A and 5B schematically illustrate steps of the magnet preparation method according to another embodiment of the invention.
Figure 5B:
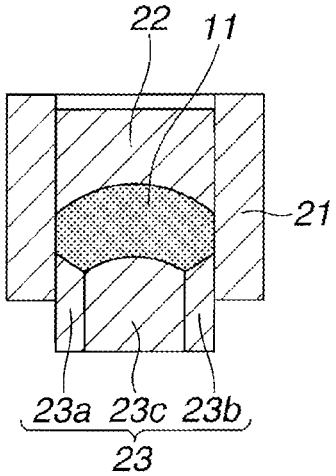

After the selected punch segments (first punch segments) are moved down (FIG. 4(E)), the upper punch 22 and the lower punch 23 (normally joined first punch segments 23*a*, 23*b* and second punch segment 23*c*) are forced relative to each other to apply a uniaxial pressure to the alloy powder in the mold cavity under a magnetic field to form a compact (or magnet precursor) la as shown in FIG. 4(F), while the shape of the pressure surface of the lower punch 23 during the compression step is maintained, that is, the relative position of the selected punch segments (first punch segments) and the remaining punch segments (second punch segment) is fixed.

Figure 6A:
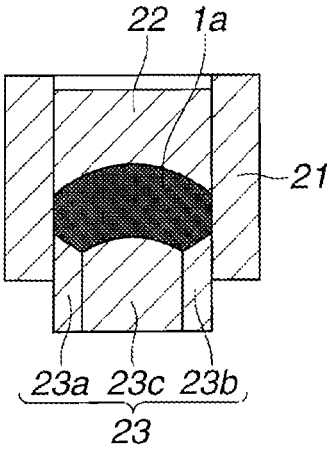
FIGS. 6A and 6B illustrate the step of withdrawing the compact from the die according to a further embodiment of the invention.
Figure 6B:
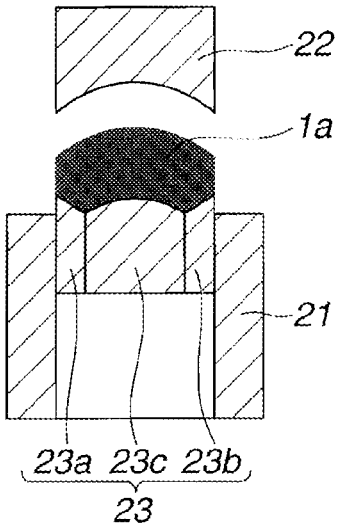

After the compression molding step mentioned above, the compact is removed from the mold. Preferably the compact is withdrawn from the die by relatively moving the upper and lower punches and the die while the compact in the mold is kept compressed by the upper and/or lower punch. For example, the compact 1*a* resulting from uniaxial compression molding in a magnetic field as shown in FIG. 6(A) may be withdrawn from the die 21 by moving the upper and lower punches 22 and 23 and the die 21 relatively in vertical direction (that is, moving the die 21 up or down relative to the upper and lower punches 22 and 23, specifically moving the die 21 up or down and/or moving the upper and lower punches 22 and 23 down or up) while the compact in the mold is kept under pressure by the upper punch 22 and/or lower punch 23 (i.e., without releasing the pressure to zero).

The step of withdrawing the compact from the die while keeping the compact under pressure ensures to prevent the compact from cracking and fissure. The pressure applied to the compact, in each molding step and per compact, is preferably up to 0.5 MPa/cm$^2$, more preferably up to 0.2 MPa/cm$^2$, and even more preferably up to 0.15 MPa/cm$^2$, and at least 0.01 MPa/cm$^2$, more preferably at least 0.05 MPa/cm$^2$ of a transverse section of the die perpendicular to the pressure application direction. The pressure applied during the withdrawing step is preferably equal to or lower than the pressure applied during the compression molding step. Once the pressure applied during the compression molding step is released (i.e., to zero), the pressure necessary for the withdrawing step may be set by applying a predetermined pressure again. However, the pressure necessary for the withdrawing step is preferably set by releasing the pressure applied during the compression molding step in a controlled manner until the predetermined pressure is reached. The pressure applied to the compact may be kept constant during the relative movement of the upper and lower punches and the die, or increased or decreased midway the relative movement.

In the step of compression molding the alloy powder in the mold cavity, a magnetic field of 1.0 to 2.5 T may be applied. The pressure applied to the fill, in each molding step and per compact, may be at least 0.1 MPa/cm$^2$, more preferably at least 0.15 MPa/cm$^2$ and up to 1 MPa/cm$^2$, more preferably up to 0.9 MPa/cm$^2$ of a transverse section of the die perpendicular to the pressure application direction.

Finally, the compact is heat treated into a sintered rare earth magnet. Specifically, the compact is sintered in a heat treatment furnace in high vacuum or a non-oxidizing gas atmosphere such as argon at a temperature of 1,000 to 1,200° C. for 1 to 10 hours. The sintering may be followed by further heat treatment (aging treatment) in vacuum or a non-oxidizing gas atmosphere such as argon at a lower temperature than the sintering temperature, preferably 400 to 700° C.

EXAMPLE

Examples are given below for further illustrating the invention although the invention is not limited thereto.

Example 1

A neodymium-based magnet alloy consisting of 25.0 wt % Nd, 7.0 wt % Pr, 1.0 wt % Co, 1.0 wt % B, 0.2 wt % Al, 0.1 wt % Zr, 0.2 wt % Cu, and the balance of Fe was coarsely crushed by hydrogen decrepitation and finely milled on a jet mill, obtaining a fine powder having an average particle size of 3.0 μm. Sintered rare earth magnets were prepared from this alloy powder, using a molding apparatus including a mold configured as shown in FIG. 2. The mold consists of a die 21, an upper punch 22 and a lower punch 23. The die 21 has a bore of 50 mm×70 mm×70 mm (height). The upper punch 22 has a downward pressure surface which is a curved surface of arcuate arch shape. The lower punch 23 has an upward pressure surface consisting of a central surface section which is a curved surface of arcuate arch shape and two planar flanks extending from opposite side edges of the central surface section and inclined toward the convex side of the arch. The lower punch 23 consists of two first punch segments 23*a*, 23*b* providing the flanks as pressure surface and a second punch segment 23*c* providing the central surface section as pressure surface.

First the die 21 was combined with the lower punch 23 to define a cavity. Two first punch segments 23*a*, 23*b* were moved up and positioned such that the pressure surface of the first punch segments 23*a*, 23*b* was 17 mm higher than the pressure surface of the second punch segment 23*c*, rather than the normal shape that the pressure surface of the lower punch 23 should take during the compression step. Next, the mold cavity was filled with the alloy powder up to the upper edge of the die 21 so that the alloy powder 11 had a height of 40 mm. The top of the alloy powder was leveled.

Next, the die 21 was slightly moved up until a space was created above the alloy powder 11. The upper punch 22 was inserted in the die space and rested on the alloy powder 11. The first punch segments 23*a*, 23*b* were moved down 17 mm. At this position, the first punch segments 23*a*, 23*b* and the second punch segment 23*c* together assumed the normal shape of the lower punch 23 during the subsequent compression step.

Next, the alloy powder was compression molded in a magnetic field of 1.5 T and under a pressure of 0.3 MPa/cm$^2$ into a compact. The pressure was gradually released to a certain level. While the compact was kept under a pressure of 0.05 MPa/cm$^2$, 0.1 MPa/cm$^2$, or 0.15 MPa/cm$^2$ between the upper and lower punches 22 and 23, the die 21 was moved down until the compact was withdrawn from the die 21. The compact of C shape as shown in FIG. 1 was obtained.

The compacts were placed in a heat treatment furnace where they were sintered in vacuum at 1,040° C. for 3 hours, followed by heat treatment in vacuum at 480° C. for 3 hours. In this way, there were obtained 30 sintered magnets. After surface polishing, the magnets were inspected for cracks in the interior (bulk cracks) and cracks on the surface (surface cracks). The number of bulk cracked magnet samples and surface cracked magnet samples was counted, with the results shown in Table 1.

Example 2

Sintered rare earth magnets were prepared as in Example 1 except that the pressure surface of the first punch segments 23*a*, 23*b* was set 20 mm higher than the pressure surface of the second punch segment 23*c* prior to the filling step, and the alloy powder had a height of 41.5 mm. The number of cracked samples was similarly counted, with the results shown in Table 1.

Comparative Example 1

Sintered rare earth magnets were prepared as in Example 1 except that the first punch segments 23*a*, 23*b* were not moved up prior to the filling step, and the alloy powder had a height of 33 mm. The number of cracked samples was similarly counted, with the results shown in Table 1.

Comparative Example 2

Sintered rare earth magnets were prepared as in Example 1 except that the first punch segments 23*a*, 23*b* were not moved up prior to the filling step, and the alloy powder had a height of 40 mm. The number of cracked samples was similarly counted, with the results shown in Table 1.

TABLE 1

| | Moved up height (mm) | Fill height (mm) | Pressure during withdrawal (MPa/cm$^2$) | Bulk cracked samples | Surface cracked samples |
|---|---|---|---|---|---|
| Example 1 | 17 | 40 | 0.05 | 7/30 | 0/30 |
| | | | 0.1 | 0/30 | 0/30 |
| | | | 0.15 | 0/30 | 3/30 |
| Example 2 | 20 | 41.5 | 0.05 | 3/30 | 0/30 |
| | | | 0.1 | 0/30 | 0/30 |
| | | | 0.15 | 0/30 | 2/30 |
| Comparative Example 1 | 0 | 33 | 0.05 | 9/30 | 0/30 |
| | | | 0.1 | 0/30 | 7/30 |
| | | | 0.15 | 0/30 | 10/30 |
| Comparative Example 2 | 0 | 40 | 0.05 | 12/30 | 0/30 |
| | | | 0.1 | 2/30 | 6/30 |
| | | | 0.15 | 0/30 | 15/30 |

It is evident that the magnets prepared in Examples 1 and 2 are improved in crack control over the magnets prepared in Comparative Examples 1 and 2.

Comparative Example 3

Sintered rare earth magnets were prepared as in Example 1 except that after compression molding, the pressure was fully released to 0 MPa, and the compact was withdrawn from the die without applying any pressure to the compact by the upper and lower punches. The number of cracked samples was similarly counted, with the results shown in Table 2.

Comparative Example 4

Sintered rare earth magnets were prepared as in Example 2 except that after compression molding, the pressure was fully released to 0 MPa, and the compact was withdrawn from the die without applying any pressure to the compact by the upper and lower punches. The number of cracked samples was similarly counted, with the results shown in Table 2.

TABLE 2

| | Moved up height (mm) | Fill height (mm) | Pressure during withdrawal (MPa/cm$^2$) | Bulk cracked samples | Surface cracked samples |
|---|---|---|---|---|---|
| Comparative Example 3 | 17 | 40 | 0 | 30/30 | 0/30 |
| Comparative Example 4 | 20 | 41.5 | 0 | 30/30 | 0/30 |

The magnets prepared in Comparative Examples 3 and 4 without applying any pressure to the compact upon withdrawal from the die showed a bulk cracked sample count of 100%. For the magnets prepared in Examples 1 and 2 wherein the compact was withdrawn from the die while keeping the compact under a certain pressure, bulk cracking was controlled.

Example 3

Sintered rare earth magnets were prepared as in Example 1 except that a magnetic field of 1.5 T was applied when the first punch segments 23*a*, 23*b* were moved down to the position where the first punch segments 23*a*, 23*b* and the second punch segment 23*c* together assumed the normal shape of the lower punch 23 during the compression step. The number of cracked samples was similarly counted, with the results shown in Table 3.

TABLE 3

| | Moved up height (mm) | Fill height (mm) | Pressure during withdrawal (MPa/cm$^2$) | Bulk cracked samples | Surface cracked samples |
|---|---|---|---|---|---|
| Example 3 | 17 | 40 | 0.05 | 0/30 | 0/30 |
| | | | 0.1 | 0/30 | 0/30 |
| | | | 0.15 | 0/30 | 2/30 |

As is evident from the results of Example 3, crack formation is further controlled by moving down the first punch segments in an applied magnetic field.

Japanese Patent Application No. 2014-080219 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A method for preparing a rare earth sintered magnet from a corresponding alloy powder using a mold, said mold comprising a die, an upper punch having a pressure surface, and a lower punch having a pressure surface, the pressure surface of one or both of the upper and lower punches being shaped non-planar, the lower punch being divided into a plurality of punch segments which are independently movable within the die in a compression direction, provided that the pressure surface of the lower punch during a compression step has a normal shape, a cavity being defined between the die and the lower punch, said method comprising the steps of:

moving one or more selected punch segments upward such a position that their pressure surface is positioned relatively higher than the pressure surface of the remaining punch segments, filling the cavity with the alloy powder, moving the selected punch segments downward until they join with the remaining punch segments to assume the normal shape of the lower punch during the compression step, compressing the alloy powder in the cavity between the upper and lower punches, while the normal shape of the pressure surface of the lower punch is maintained, under a magnetic field for uniaxial pressure molding to form a compact, and heat treating the compact, wherein in the step of moving the selected punch segments downward, the selected punch segments are moved down while a magnetic field is applied.

2. The method of claim 1, further comprising, after the pressure molding step, the step of withdrawing the compact from the die by relatively moving the upper and lower punches and the die while the compact in the mold is kept under pressure by both of the upper and lower punches.

3. The method of claim 2 wherein during the step of withdrawing the compact, the pressure on the compact is increased or decreased when the upper and lower punches and the die are relatively moved.

4. The method of claim 1 wherein the top of the alloy powder is leveled during or after the filling step.

5. The method of claim 1 wherein the selected punch segments are disposed at positions where the vertical thickness of the compact is thin.

6. The method of claim 1 wherein at least a portion of the pressure surface of one or both of the upper and lower punches is a curved surface of arch or inverse arch shape.

7. The method of claim 1 wherein the pressure surface of the upper punch is a curved surface of arcuate arch shape.

8. The method of claim 7 wherein the pressure surface of the lower punch consist of a central surface section having parallel side edges and two flanks extending from the side edges of the central surface section.

9. The method of claim 8 wherein the central surface section is a horizontal surface or a curved surface of arcuate arch shape, and the flank is a horizontal surface or a curved or flat surface inclined toward the convex side of the arch.

10. The method of claim 8 wherein the selected punch segments of the lower punch are two punch segments having a pressure surface corresponding to the flanks, and the remaining is one punch segment having a pressure surface corresponding to the central surface section.

11. The method of claim 2, further comprising, between the step of filling and the step of moving the selected punch segments downward, the steps of moving the die upward and/or the overall lower punch downward, and then resting the upper punch on top of the alloy powder.

12. The method of claim 1 wherein the lower punch is divided into two punch segments corresponding to said selected punch segments, and one punch segment corresponding to said remaining punch segment and providing the central section of the pressure surface of the lower punch.

13. The method of claim 12 wherein, in the step of withdrawing, the pressure applied to the compact, in each molding step and per compact, is 0.01 to 0.5 MPa/cm$^2$ of a transverse section of the die perpendicular to the pressure application direction.

14. The method of claim 1 wherein the pressure surface of the upper punch is shaped non-planar.

15. The method of claim 14 being for preparing a rare earth sintered magnet having ID shape.

16. The method of claim 14 wherein the pressure surface of the lower punch is shaped non-planar.

17. The method of claim 16 being for preparing a rare earth sintered magnet having C shape.

18. The method of claim 14 wherein the upper punch has a downward pressure surface corresponding to the upper surface of the magnet, and the lower punch has an upward pressure surface corresponding to the lower surface of the magnet.

19. The method of claim 1 wherein, in the step of heat treating, the compact is sintered in a heat treatment furnace in high vacuum or a non-oxidizing gas atmosphere at a temperature of 1,000 to 1,200° C. for 1 to 10 hours.

* * * * *